US006647944B2

(12) United States Patent
Kamiya

(10) Patent No.: US 6,647,944 B2
(45) Date of Patent: Nov. 18, 2003

(54) CYLINDER BLOCK STRUCTURE

(75) Inventor: Masahisa Kamiya, Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 103 days.

(21) Appl. No.: 10/016,927

(22) Filed: Dec. 14, 2001

(65) Prior Publication Data

US 2002/0148432 A1 Oct. 17, 2002

(30) Foreign Application Priority Data

Apr. 17, 2001 (JP) ..... 2001-117871

(51) Int. Cl.[7] ..... F02F 7/00
(52) U.S. Cl. ..... 123/195 R; 123/195 H
(58) Field of Search ..... 123/195 R, 195 H, 123/55.2, 55.5, 52.1, 53.1, 192.2, 509

(56) References Cited

U.S. PATENT DOCUMENTS 3,884,201 A * 5/1975 Cregan ..... 123/572
4,637,354 A * 1/1987 Tominaga et al. ..... 123/54.4
4,974,449 A * 12/1990 Core ..... 73/460
5,758,551 A * 6/1998 Ozeki ..... 74/603

FOREIGN PATENT DOCUMENTS

JP 04292529 10/1992
JP 4292529 * 10/1992

* cited by examiner

*Primary Examiner*—Mahmoud Gimie
(74) *Attorney, Agent, or Firm*—Darby & Darby

(57) ABSTRACT

A cylinder block structure includes a plurality of mounting bolts extending through a plurality of bearing caps and through a crank case to fix a crank shaft in a cylinder block. During operation, the crank shaft transmits detrimental horizontal stress to the bearing caps, the mounting bolts, and the crank case. A bulge portion, a plurality of reinforcing ribs, boss portions, and reinforcing oil transport structures extend away from the cylinder block to resist the horizontal stresses and prevent deformation of the mounting bolts and the bearing caps. An engine mount bracket secures the cylinder block structure to an external position and provides additional rigidity. The bulge portion, reinforcing ribs, boss portions and other structures minimize vibration and allow close tolerances by providing rigidity to the cylinder block structure without increasing wall thickness.

9 Claims, 12 Drawing Sheets

IGNITION SEQUENCE : #1→#8→#4→#3→#6→#5→#7→#2

CYLINDER BLOCK STRUCTURE

BACKGROUND OF THE INVENTION

1. Field of the Invention

The present invention relates to a cylinder block structure in a V-type engine. More particularly, the present invention relates to a cylinder block structure in which a means for resisting distorting horizontal forces during engine operation is introduced, wherein such means includes a bulge portion extending away from at least one side of the walls of a crank case.

2. Description of the Related Art

Conventional internal combustion vehicle engines include in-line cylinder engines, opposed-cylinder engines, and V-type engines. V-type engines have cylinder banks disposed in a relative V-shape.

Alternative configurations exist for V-type engines. In one configuration, an upper surface of a crank case mounts on a lower surface of a V-shaped cylinder block. In this configuration, an oil pan mounts on the lower surface of the crank case, and the V-shaped cylinder block supports a crank shaft in cooperation with bearing caps integrated with the crank case. In this configuration, a first and a second cylinder head are positioned on the upper surfaces of a first and a second cylinder bank.

Referring now to FIG. 8, a V-type engine 102 includes a first through an eighth cylinder (#'s 1 to #8 not shown) disposed in a V-shaped cylinder block 104 (alternatively referred to as cylinder block 104).

Cylinder banks 106A and 106B are symmetrical on one-side and an opposite-side of an engine center line EC in V-shaped cylinder block 104. Cylinder banks 106A are centered on a one-side cylinder center line CA. Cylinder banks 106B are centered on an opposite-side cylinder center line CB.

Cylinder heads 108A and 108B are symmetrical on one-side and an opposite-side of engine center line EC. A bearing construction member 110 is below cylinder heads 108A, 108B.

A crank case 112 supports V-shaped cylinder block 104. A set of bearing caps 114 (referred to as bearing caps 114) are on crank case 112. A crank shaft 116 (shown later) drives the first through eights cylinders, as will be explained. Bearing construction member 110 includes crank case 112 integrated with bearing caps 114.

An oil pan 118 is located below V-shaped cylinder block 104 and bearing construction member 110, to aid oil circulation during engine operation.

Conventionally, cylinder block 104 and crank case 112 are formed from aluminum. Bearing caps 114 are usually iron.

One-side cylinder bank 106A includes one-side cylinders 120A, specifically, the first, third, fifth, and seventh cylinders (that is, the cylinders identified with odd numbers) in one-side cylinder bank 106A. One-side cylinders 120A extend in a lengthwise direction along one-side cylinder bank 106A.

Opposite-side cylinder bank 106B includes opposite-side cylinders 120B, specifically, the second, fourth, sixth, and eighth cylinders (having even numbers) in opposite-side cylinder bank 106B. Opposite-side cylinders 120B extend in a lengthwise direction along opposite-side cylinder bank 106A.

One-side cylinder center line CA passes through the center of one-side cylinders 120A. Opposite-side cylinder center line CB passes through the center of opposite-side cylinders 120B.

One-side cylinder center line CA is set at a one-side angle θ1 from engine center line EC. Opposite-side cylinder center line CB is set at an opposite-side angle θ2 from engine center line EC. Engine center line EC passes through a center O of crank shaft 116. An including angle α (for example 60°) exists between engine center line EC and respective one-side and opposite-side center lines CA, CB. Including angle α is equally divided between a one-side angle θ1 and an opposite-side angle θ2 on respective sides of engine center line EC.

During assembly of V-type engine 102, an upper surface of crank case 112 mounts to a lower surface of V-shaped cylinder block 104. Oil pan 118 is then mounted on a lower surface of crank case 112 by an attachment fitting (not shown). V-shaped cylinder block 104, in cooperation with bearing caps 114, rotatably supports crank shaft 116 in a forward and a rearward direction along V-type engine 102.

During further assembly, respective one-side and opposite-side cylinder heads 108A, 108B are placed on the upper surfaces of each respective one-side and opposite-side cylinder banks 106A, 106B.

In bearing construction member 110, a plurality of lower mounting bolts 122, extending through bearing caps 114, mount crank case 112 on the lower surface of V-shaped cylinder block 104. Lower mounting bolts 122 integrally hold bearing caps 114 and crank case 112 to V-shaped cylinder block 104. A side mounting bolt 124 integrally holds each respective bearing cap 114 from the side of bearing construction member 110.

A main oil path 156 is in the side wall of V-shaped cylinder block 104 in a lengthwise direction. During operation, oil circulates through main oil path 156 to cool and lubricate V-type engine 102.

Referring now to FIG. 9, a first to a fifth crank journal, sequentially 126-1, -2, -3, -4, and -5 are formed on crank shaft 116 and spaced a predetermined distance from each other. A first to an eighth crank pin, sequentially 128-1, . . . -8, are also formed on crank shaft 116, in positions corresponding to respective cylinders, as will be explained.

Since V-type engine 102 is an eight-cylinder engine, first through eighth crank pins 128-1 to -8 are numbered #1 to #8 respectively for each respective cylinder.

A pair of first crank weights 130-1A, 130-1B are on either side of first crank pin 128-1. A second crank weight 130-2 is between third crank pin 128-3 and fourth crank pin 128-4. A third crank weight 130-3 is between fifth crank pin 128-5 and sixth crank pin 128-6. A pair of fourth crank weights 130-4A, 130-4B are on either side of eighth crank pin 128-8.

A first and a second crank arm 132-1, 132-2, are on either side of second crank journal 126-2. A third and a fourth crank arm 132-3, 132-4, are on either side of third crank journal 126-3. A fifth and a sixth crank arm 132-5 and 132-6 are on either side of fourth crank journal 126-4.

A pulley mounting projection 134 is on an end of crank shaft 116 adjacent first crank journal 126-1. A starter motor gear 136 on the other end of crank shaft 116 adjacent fifth crank journal 126-5.

A plurality of semicircular block side shaft holes 138 extend through the lower surface of cylinder block 104. Shaft holes 138 correspond to respective crank journal 126-1 to -5 (shown later) on crank shaft 116. In contrast to shaft holes 138, bearing caps 114 each have case side bearing portions 142. Bearing portions 142 each have respective semicircular case side shaft holes 140 corresponding to respective crank journals 126 on crank shaft 116. In operation, crank shaft 116 rotates clockwise in rotation direction R.

Referring now to FIGS. 10 to 14, crank weights 130-1 to 130-4 extend away from the moving center of crank shaft 16 (as shown), and aid in force-balancing V-type engine 102 during operation.

Referring now to FIGS. 15 and 16, bearing metals 144 rotatably support crank shaft 116 between respective block side shaft holes 138 (of cylinder block 104) and case side shaft holes 140 (of bearing caps 114).

A plurality of one-side connecting rods 146A (numbered -1 through -8) and opposite-side connecting rods 146B (numbered -1 through -8) join to crank shaft 116 and operate in respective one- and opposite-side cylinder banks 106A, 106B, as will be explained. For convenience, member specific to the fourth cylinder in V-type engine 102 are shown. (i.e. 146B-4, 120B-4, CB-4 etc.) Each one-side and each opposite-side connecting rod 146A-1 to -8 and 146B-1 to -8 has a large end and a small end.

In each one-side cylinder 120A, a set of one-side connecting bolts 150A joins the large end of each respective one-side connecting rod 146A to respective crank pins 128 with a one-side cap 148A.

In each opposite-side cylinder 120B, a set of opposite-side connecting bolts (not shown) joins the large end of each respective opposite side connecting rod 146B to respective crank pins 128 with an opposite-side cap (not shown).

A one-side piston 152A is in each respective one-side cylinder 120A. One-side piston pins 154A connect each respective one-side piston 152A to the small ends of each respective one-side connecting rod 146A.

An opposite-side piston 152B is in each respective opposite-side cylinder 120B. (i.e. opposite-side piston 152B-4 is in opposite-side cylinder 120B-4) Respective opposite side piston pins 154B connect each opposite-side piston 152B to the small ends of each respective opposite-side connecting rod 146B.

The eight-cylinders in V-type engine 102 are numbered first cylinder (#1) through eighth cylinder (#8). During operation of V-type engine 102, the respective cylinders are ignited in sequences as shown, namely, the ignition sequence is #1, #8, #4, #3, #6, #5, #7, and #2.

When V-type engine 102 operates, loads from respective one-side pistons 152A (with one-side connecting rods 146A), and the respective opposite-side pistons 152B, (with opposite-side connecting rods 146B), are applied to crank shaft 116 and received by bearing caps 114 during each cylinder ignition.

When explosion arises in the engine 102, the loads of the respective cylinders (#1 to #8 (not shown)) are applied respectively along the direction of one-side cylinder center line CA and in the direction of opposite-side cylinder center line CB.

These loads each affect V-type engine 102 differently since each is affected by the sequence of ignition and by the inertial forces of the first to fourth crank weights 130-1 to 130-4 of respective adjacent cylinders. These loads also differ for engines having 4 or 6 cylinders.

Referring now to FIG. 17, when the fourth cylinder (#4) is ignited in sequence (shown as 4S in FIG. 16), a load having a horizontal portion P4, is applied horizontally to respective bearing cap 114. When the third cylinder (#3) is ignited in sequence (shown as 3S in FIG. 16), a load having a horizontal portion P3, is applied horizontally to respective bearing cap 114.

Thus, when fourth opposite-side piston 152B-4 (of fourth cylinder (#4) in opposite-side pistons 152B) receives an explosive load along the direction of the fourth opposite-side cylinder center line CB-4, this explosive load is also applied to bearing cap 114. During receipt of this explosive load, an inertial force of third crank weight 130-3 (counter weight) of crank shaft 116 is at least twice as large as the inertial force of second crank weight 130-2 (counter weight) of crank shaft 116. Thus, as can be shown from force analysis, during ignition of fourth cylinder (#4), a resultant force FK is applied substantially horizontally to bearing cap 114. Resultant force FK is obtained by adding a resultant force F1, of a load W, and an inertial force K1, to an inertial force K2. Loads Q1, Q2 from crank shaft 116 are also applied horizontally to bearing caps 114.

A similar phenomenon arises during ignition/explosion in the sixth cylinder (#6). The resultant force (now shown) from the explosion load and the inertial force of fourth counter weight 130-4 is applied horizontally to bearing cap 114 by the affect of the above inertial force.

In the conventional cylinder block structure described above, frequent problem arise since the lower mounting bolts 122 are deformed by the horizontally applied loads from crank shaft 116, and the case side crank shaft holes (not shown) are similarly deformed. As a result of such deformation, clearances between the case side crank shaft holes and crank shaft 116 are detrimentally increased and result in damaging engine vibration and noise.

In one attempt to remedy this concern, as disclosed in the cylinder block of Japanese Patent No. 3109118, attachment brackets are positioned across a series of joint portions between a cylinder block and corresponding bearing caps and are secured to a side of the cylinder block and to the sides of the bearing caps.

Alternatively, to overcome the above disadvantage, countermeasures may include increasing the case side wall thickness of an aluminum crank case, adding a reinforcing member, or changing the material of the crank case (to use iron). Unfortunately, each of these countermeasures is accompanied by a disadvantageous weight and cost increase.

OBJECTS AND SUMMARY OF THE INVENTION

It is an object of the present invention to provide a cylinder block structure which overcomes the disadvantages described above.

It is another object of the present invention to provide a cylinder block structure with increased rigidity and a lower risk of failure.

It is another object of the present invention to increase the rigidity of a crank case to resist horizontal forces from a crank shaft and minimize load deformation while maintaining selected bearing gaps.

The present invention relates to a cylinder block structure including a plurality of mounting bolts extending through a plurality of bearing caps and a crank case to fix a crank shaft in a cylinder block. During operation, the crank shaft transmits detrimental horizontal stress to the bearing caps, the mounting bolts, and the crank case. A bulge portion, a plurality of reinforcing ribs, boss portions, and reinforcing oil transport structures extend away from the cylinder block and resist the horizontal stresses and prevent deformation of the mounting bolts and the bearing caps. An engine mount bracket secures the cylinder block structure to an external position and provides additional rigidity. The bulge portion, reinforcing ribs, boss portions and other structures minimize vibration and allow close tolerances by providing rigidity to the cylinder block structure without increasing wall thickness.

According to an embodiment of the present invention there is provided a cylinder block structure, comprising: a crank case, the crank case on a first lower surface of a V-type cylinder block, a first set of bearing caps mounted on the crank case, the cylinder block and the first set of bearing caps operably supporting a crank shaft along a center axis of the cylinder block structure, the crank shaft transmitting a distorting force to at least the first set and a one-side wall of the crank case during an engine operation, means for preventing a distortion of the at least first set and the one-side wall during the engine operation, at least a bulge portion in the means for preventing, and the bulge portion extending away from at least the one-side wall and reinforcing the first set and the one-side wall, whereby the means for preventing resists the distorting horizontal force and prevents the distortion.

According to another embodiment of the present invention there is provided a cylinder block structure, further comprising: a oil pump in the means for preventing, the oil pump mounted on a second lower surface of the bulge portion opposite the crank shaft, a first oil path in the means for preventing, a first oil path on a bulge side surface of the bulge portion opposite the crank shaft, the first oil path in fluid communication with a discharge path of the oil pump, a second oil path in the means for preventing, a second oil path on the a block side wall of the cylinder block opposite the crank shaft, and the second oil path providing fluid communication between the first oil path and a main oil path in the cylinder block, whereby the oil pump and the first and the second oil paths resists the distortion.

According to another embodiment of the present invention there is provided a cylinder block structure, further comprising: a plurality of first boss portions in the means for preventing, the first boss portions on the one-side wall and an opposite-side wall of the crank case extending away from the crank case at spaced intervals perpendicular to the crank shaft, a plurality of second boss portions in the means for preventing, the second boss portions on at least at a one-side cylinder block wall of the cylinder block extending away from the cylinder block at spaced intervals perpendicular to the crank shaft and relative to corresponding the first boss portions, an engine mounting bracket in the means for preventing, and the engine mounting bracket rigidly joining at least one of the second boss portions and at least one of the first boss portions on the one-side wall to an external support, whereby the engine mounting bracket prevents distortion of the crank case and the cylinder block relative to the external support.

According to another embodiment of the present invention there is provided a cylinder block structure, further comprising: a plurality of reinforcing ribs in the means for preventing, and the plurality of reinforcing ribs on the plurality of first boss portions on the one-side wall, whereby the reinforcing ribs stiffen the plurality of first boss portions and prevent distortion of the crank case.

According to another embodiment of the present invention there is provided a cylinder block structure, comprising: a crank case, an upper surface of the crank case on a lower surface of a V-shaped cylinder block, a bearing construction member includes the crank case and a plurality of bearing caps, an oil pan on a lower surface of the crank case, the plurality of bearing caps and the crank case rotatably supporting a crank shaft along a rotation axis in the bearing construction member, a bulge portion on at least a first case side wall of the crank case extending away from the crank case, the bulge portion having a shape and being at a position countering a distorting horizontal force from the crank shaft transmitted to the bearing caps and the crank case during an engine operation, an oil pump on a lower surface of the bulge portion, a first oil path on a bulge side surface of the bulge portion in fluid communication with a discharge path of the oil pump, and a second oil path on a block side wall of the cylinder block in fluid communication between the first oil path and a main oil path of the cylinder block, whereby the oil pump, the first oil path, and the second oil path support the bulge portion and resist the distorting horizontal load.

According to another embodiment of the present invention there is provided a cylinder block structure, further comprising: a plurality of first boss portions on the first and a second case side wall of the crank case, the plurality of first boss portions extending away from crank case at spaced intervals perpendicular to the crank shaft, a plurality of second boss portions on at least a first cylinder side wall of the cylinder block, the plurality of second boss portions extending away from the cylinder block at spaced intervals perpendicular to the crank shaft and relative to respective the first boss portions, at least one engine mounting bracket having at least an upper and a lower portion and fixed to an external support, the upper portion fixed to at least one of the second boss portions on the cylinder block on the first cylinder side wall, the lower portion fixed to at least one of the first boss portions on the crank case on the first case side wall, and the engine mounting bracket extending away from the cylinder block and the crank case to the external support, thereby preventing the distorting horizontal load from shifting the crank case, the cylinder block, and the set of bearing caps relative to the external support during the engine operation.

According to another embodiment of the present invention there is provided a cylinder block structure, further comprising: a plurality of reinforcing ribs on the plurality of first boss portions along the first case side wall, and the reinforcing ribs stiffening the plurality of first boss portions along the first case side.

According to another embodiment of the present invention there is provided a cylinder block structure, comprising: a crank case, an upper surface of the crank case on a first lower surface of a V-shaped cylinder block, a bearing construction member includes the crank case and a plurality of bearing caps, the plurality of bearing caps and the crank case rotatably supporting a crank shaft along a rotation axis of the crank case, at least a pump-mounting inclined surface on a second lower surface of the crank case, an oil pump mounted on the pump-mounting inclined surface, the pump-mounting inclined surface having a shape and a thickness countering a distorting horizontal force from the crank shaft transmitted to the bearing caps and the crank case during an engine operation, and the thickness of the pump-mounting inclined surface also increasing a rigidity of at least one case side wall of the crank case.

According to another embodiment of the present invention there is provided a cylinder block structure, comprising: a crank case; at least a first set of bearing caps mounted on said crank case; means for preventing distortion of bearing caps and said crank case during an engine operation transmitting a distorting horizontal force to said bearing caps and said crank case; a bulge portion in said means for preventing; and said bulge portion extending away from a first side wall of said crank case to reinforce at least one of said crank case and said bearing caps and resist said distorting horizontal force, whereby distortion of said cylinder block structure is prevented.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
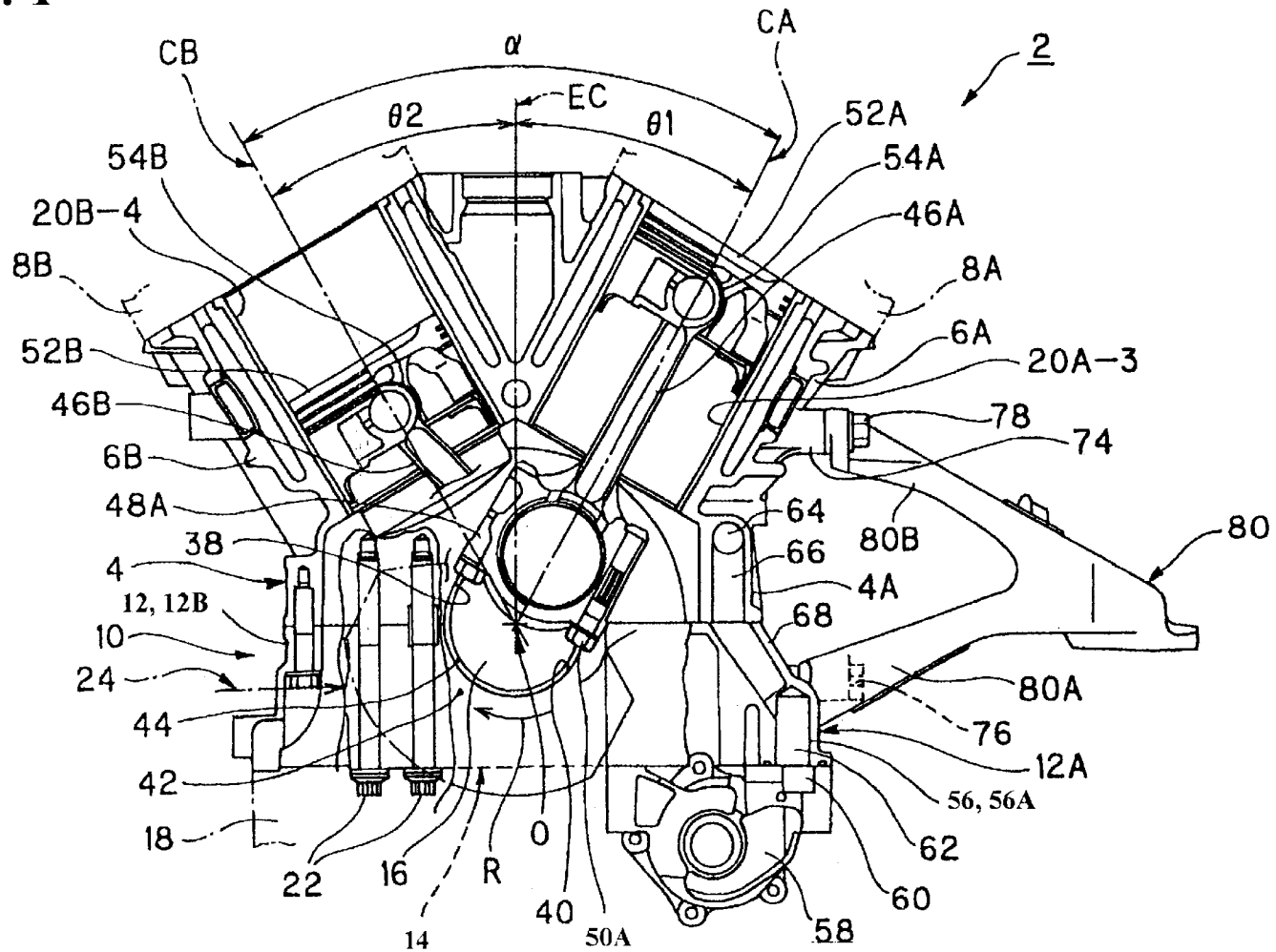
FIG. 1 is a sectional view of a V-type engine taken along the line I—I of FIG. 2 in a first embodiment of the present invention.

Referring now to FIG. 1, a V-type engine 2 includes a first through an eighth cylinder (numbered #1 to #8, not shown). V-type engine 2 includes a V-shaped cylinder block 4 having a one-side cylinder bank 6A and an opposite-side cylinder bank 6B. Center line CA is the center line of one-side cylinder bank 6A and center line CB is the center line of opposite-side cylinder bank 6B. V-type engine 2 also includes a one-side cylinder head 8A and an opposite-side cylinder head 8B.

V-type engine 2 includes a bearing construction member 10 having a crank case 12. Bearing construction member 10 also includes a plurality of bearing caps 14. A crank shaft 16 operates within V-type engine 2, as will be explained. An oil pan 18 attaches to bearing construction member 10 and aids oil supply to V-type engine 2 during operation. Bearing construction member 10 includes crank case 12 integrated with bearing caps 14.

Figure 2:
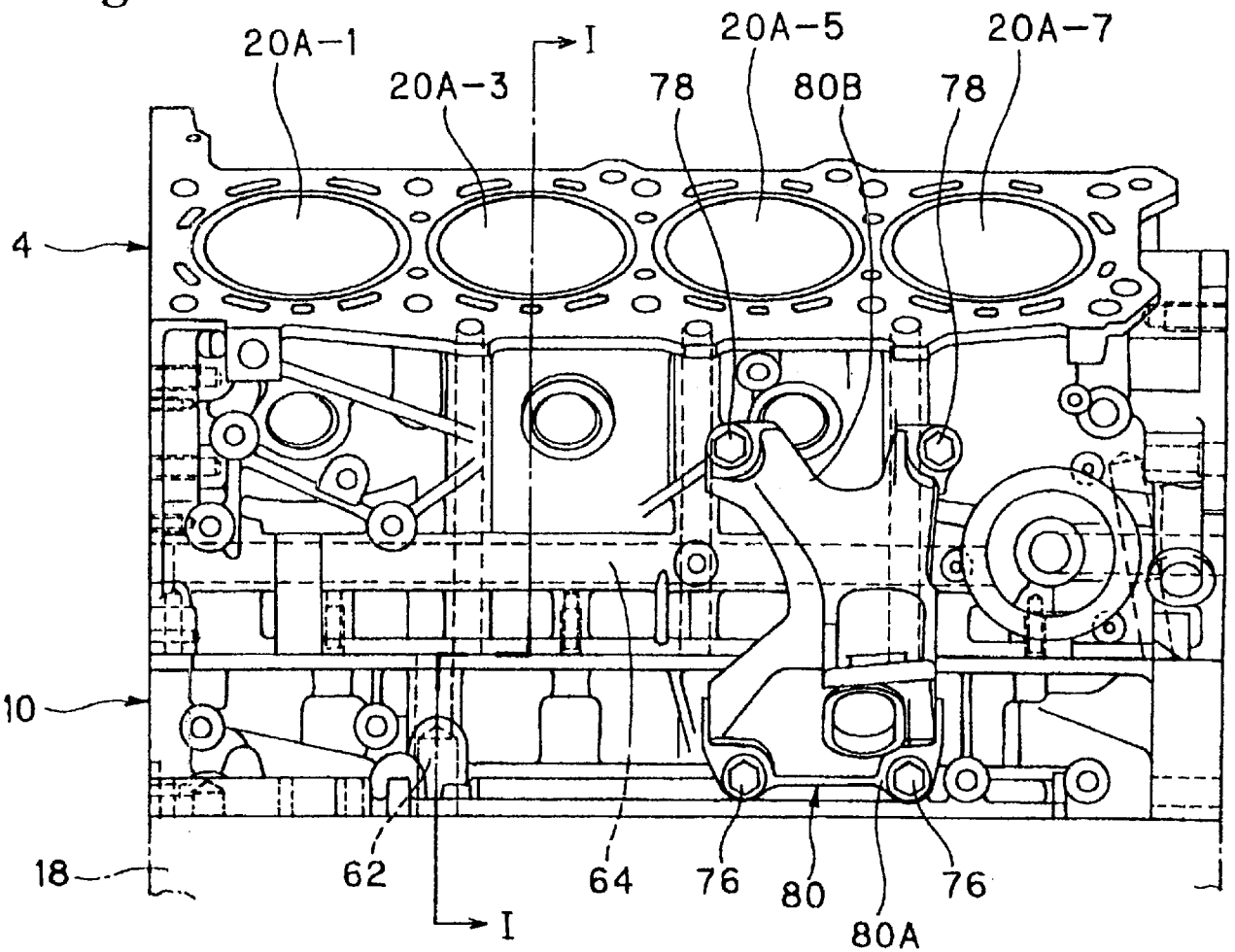
FIG. 2 is a side elevation of the V-type engine.

Additionally referring now to FIG. 2, cylinder block 4 includes a plurality of one-side cylinders 20A and opposite-side cylinders 20B.

In an eight-cylinder cylinder block 4, one-side cylinders 20A include a first cylinder 20A-1, a third cylinder 20A-3, a fifth cylinder 20A-5, and a seventh cylinder 20A-7. One-side cylinders 20A are aligned along the lengths of cylinder block 4. Opposite-side cylinders 20B include a second cylinder 20B-2, a fourth cylinder 20B-4, a sixth cylinder 20B-6, and an eighth cylinder 20B-8.

Engine center line EC passes through the center of V-type engine 2 and bisects an angle $\alpha$ formed between opposite-side center line CB, center O, and one-side center line CA. Center O passes through the rotational center of a crank shaft 16. Crank shaft 16 operates in a rotation direction R.

One-side angle $\theta 1$ is between engine center line EC and one-side center line CA. Opposite-side angle $\theta 2$ is between engine center line EC and opposite-side center line CB. Angle c maybe any angle capable of allowing V-type engine to effectively operate but may preferably be 60°.

During assembly, an upper surface of crank case 12 mounts on a lower surface of V-shaped cylinder block 4. An attachment fitting (not shown) mounts oil pan 18 on a lower surface of crank case 12. V-shaped cylinder block 4, in cooperation with bearing construction member 10 and bearing caps 14, rotatably supports crank shaft 16 in a length direction along V-type engine 2.

One-side and opposite-side cylinder heads 8A and 8B are secured on the upper surfaces of respective one-side and opposite-side cylinder banks 6A and 6B.

In bearing construction member 10, a plurality of lower mounting bolts 22 mount crank case 12 and bearing caps 14 to the lower surface of cylinder block 4. A plurality of side mounting bolts 24 integrally hold crank case 12 and bearing caps 14 together along a side.

Figure 3:
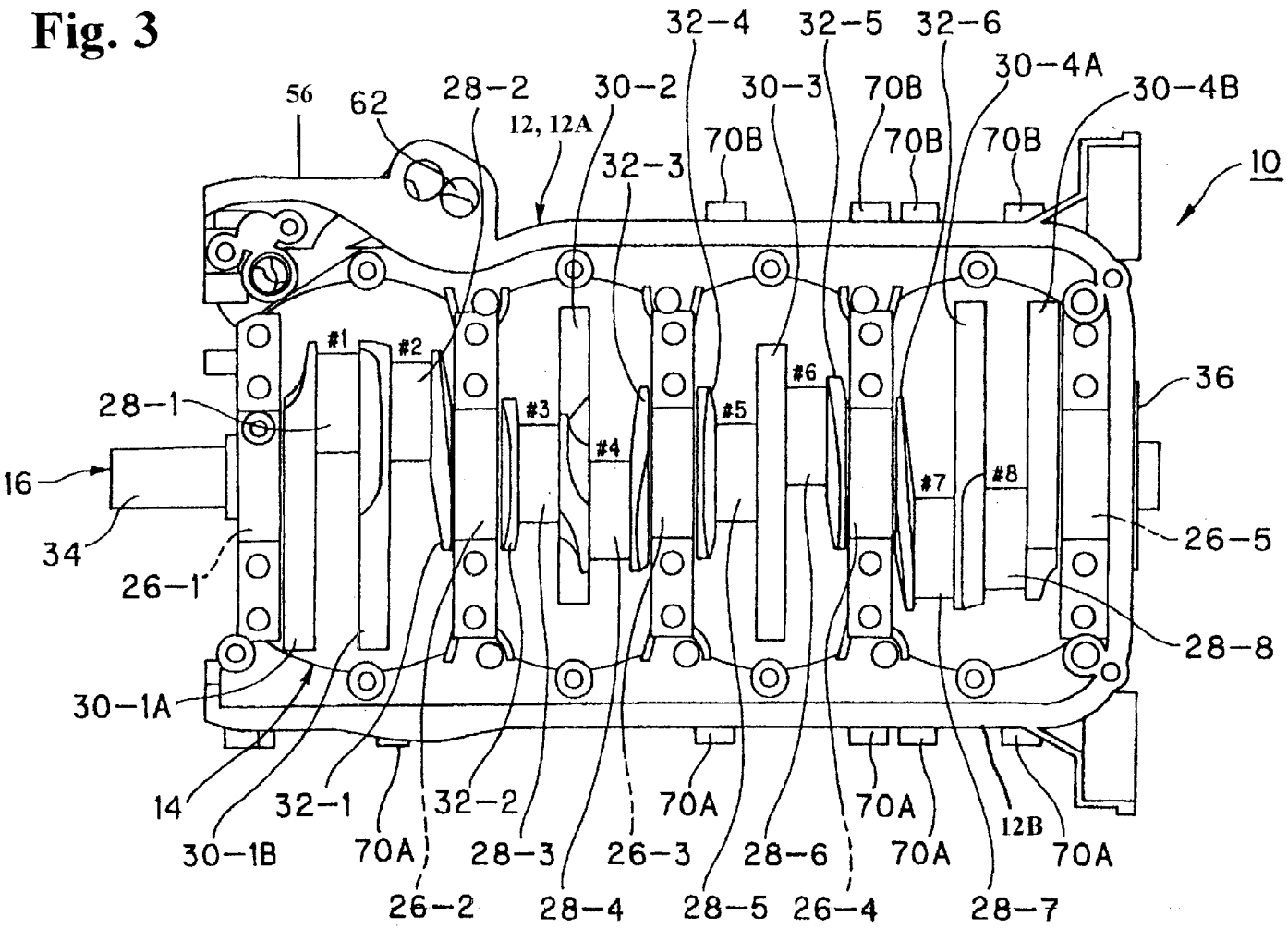
FIG. 3 is a bottom plan view of the crank case integrated with bearing caps supporting a crank shaft.

Referring now to FIG. 3, crank shaft 16 includes a first through a fifth crank journal 26-1 to 26-5. Crank journals 26-1 to 26-5 are spaced along a length of crank shaft 16, as will be described.

Crank shaft 16 also includes a first through an eighth crank pin 28-1 to 288. Crank pins 28-1 to 28-8 correspond to respective first through eighth cylinders (#1 through #8, shown later) in V-type engine 2.

A pair of first crank weights 30-1A and 30-1B are formed on opposite sides of first crank pin 28-1. A second crank weight 30-2 is between third crank pin 28-3 and fourth crank pin 28-4. A third crank weight 30-3 is between fifth crank pin 28-5 and sixth crank pin 28-6. A pair of fourth crank weights 30-4A and 30-4B are formed on opposite sides of eighth crank pin 28-8.

A first and a second crank arm 32-1, 32-2 are on opposite sides of second crank journal 26-2. A third and a fourth crank arm 32-3, 32-4 are on opposite sides of third crank journal 26-3. A fifth and a sixth crank arm 32-5, 32-6 are on opposite sides of fourth crank journal 26-4. A pulley mounting projection 34 is on one end of crank shaft 16 adjacent first crank journal 26-1. A starter motor gear 36 is on an opposite end of crank shaft 16 adjacent fifth crank journal 26-5.

A plurality of semi-circular block side shaft holes 38 extend through the lower surface of cylinder block 4 corresponding to respective crank journals 26-1 to 26-5 on crank shaft 16.

Figure 4:
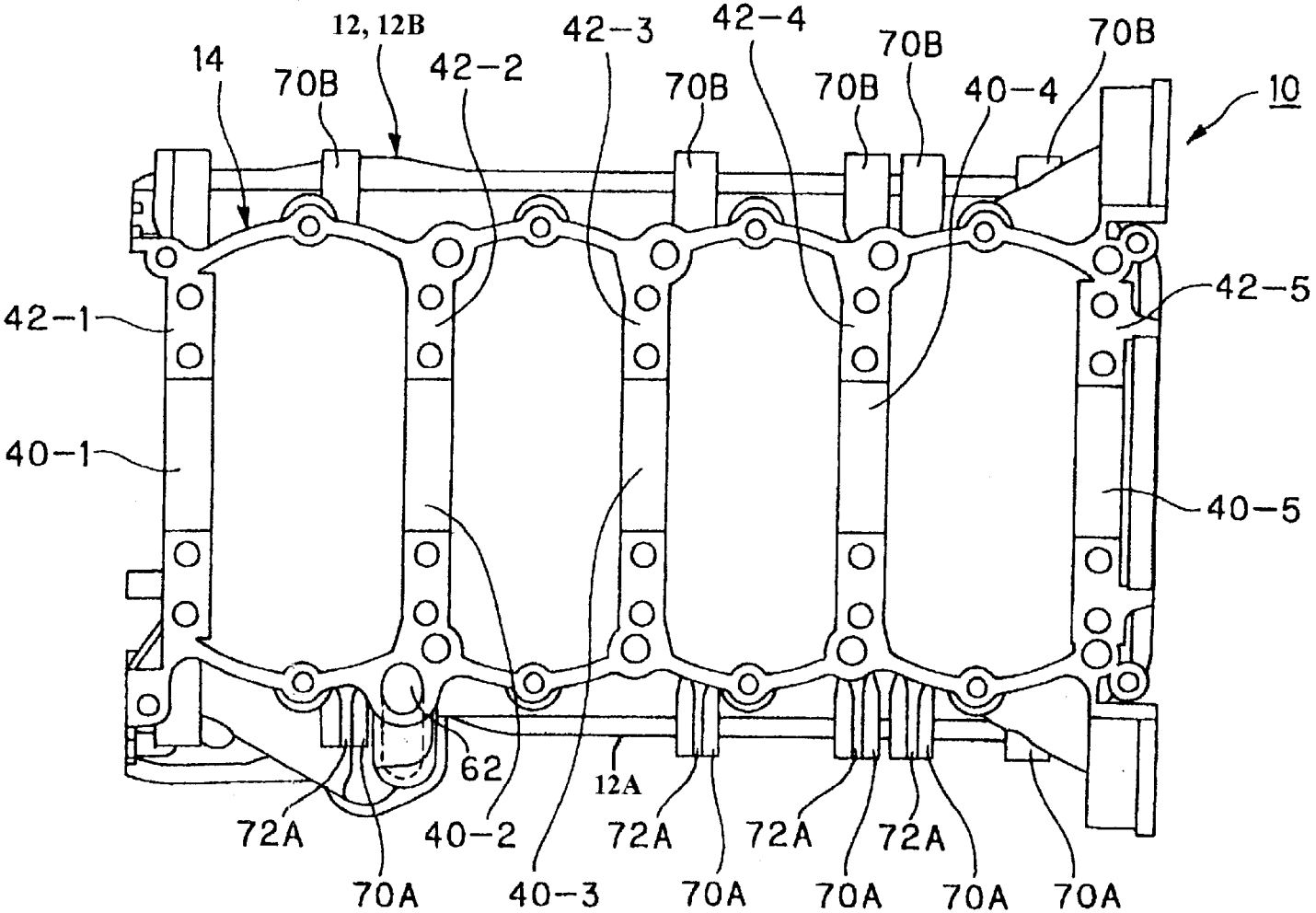
FIG. 4 is a plan view of a crank case integrated with bearing caps.

Referring now to FIG. 4, in contrast to shaft holes 38, bearing caps 14 each have a plurality of case side bearing portions 42, respectively first through fifth case side bearing portions 42-1 to 42-5. During assembly, a plurality of semicircular case side shaft holes 40, respectively a first through a fifth case side shaft hole 40-1 to 40-5, receive respective crank journals 26-1 to 26-5 of crank shaft 16.

Crank shaft 16 receives rotation support from bearing metals 44 positioned between respective block side shaft holes 38 (of cylinder block 4) and case side shaft holes 40 (of bearing caps 14).

A plurality of one-side connecting rods 46A operate relative to one-side cylinders 20A, as will be explained. A plurality of opposite-side connecting rods 46A operate in respective opposite side cylinders 20B, as will be explained. One-side connecting rods 46A and opposite-side connecting rods 46B each have a large end and a small end.

A plurality of one-side connection bolts 50A and one-side caps 48A connect respective large ends of one-side connecting rods 46A to respective crank pins 28 on crank shaft 16. A plurality of opposite-side connecting bolts (not shown) and opposite-side caps (also not shown) connect respective large ends of opposite-side connecting rods 46B to respective crank pins 28 on crank shaft 16. This type of connective arrangement is clearly shown in FIG. 1, where third one-side connecting rod 46A and fourth opposite-side connecting rod 46B are shown in V-type engine 2.

A plurality of one-side piston pins 54A pivotally connect the small ends of respective one-side connecting rods 46A to a respective plurality of one-side pistons 52A slidable in one-side cylinders 20A. A plurality of opposite-side piston pins 54B pivotally connect the small ends of respective one-side connecting rods 46B to a respective plurality of opposite-side pistons 52B, slidable in opposite side cylinders 20B.

In an eight-cylinder V-type engine 2, the ignition sequences is as follows: first cylinder (#1), eighth cylinder (#8), fourth cylinder (#4), third cylinder (#3), sixth cylinder (#6), fifth cylinder (#5), seventh cylinder (#7), and second cylinder (#2). This ignition sequence is similar to conventional eight-cylinder V-type engines.

A bulge portion 56 is formed on a front side of crank case 12. Bulge portion 56 extends away from V-shaped cylinder block 4, along a block side wall 4A. Bulge 56 has a shape and a position which resists the horizontal shear stresses applied to crank case 12 (with bearing caps 14) generated along crank shaft 16 during operation.

Bulge portion 56 extends from a one-side case side wall 12A opposite an opposite-side case side wall (shown but not numbered). Bulge portion 56 extends in a direction along rotation direction R of crank shaft 16. Bulge portion 56, as well as other elements in the present invention, are designed and positioned to minimize detrimental horizontal distortion and increase engine life.

An oil pump 58 mounts on a lower surface of bulge portion 56. Specifically, oil pump 58 mounts on a lower end of crank case 12 to reduce a total length of V-type engine 2. Further, oil pump 58 is specifically located at a position extending outward from crank case 12 to prevent interference between oil pump 58 and crank shaft 16.

A first oil path 62 is formed on a Bulge side wall 56A of Bulge portion 56. First oil path 62 communicates with a discharge path 60 of oil pump 58.

A second oil path 66 is formed onto block side wall 4A and communicates with both first oil path 62 as well as a main oil path 64. Main oil path 64 is on V-shaped cylinder block 4.

First oil path 62 is on an oil path boss portion 68 that extends to, and communicates with, second oil path 66. Oil path boss portion 68 is a portion of bearing construction member 10 and projects outward away from V-shaped cylinder block 4. The position and design of oil path boss portion 68, first and second oil paths 62, 66, main oil path 64, and Budge side wall 56A all contribute to the horizontal rigidity of bearing caps 14.

To further resist horizontal deformation and increase rigidity, a plurality of first one-side and opposite-side boss portions 70A, 70B are on respective one-side and opposite side case side walls 12A, 12B. First one-side and opposite-side boss portions 70A, 70B are collectively referred to as first boss portions 70.

First one-side and opposite-side boss portions 70A, 70B are formed in positions selected to resist horizontal loads applied from crank shaft 16 to crank case 12 and bearing caps 14.

First one-side and opposite-side boss portions 70A, 70B are positioned on respective one-side and opposite-side case side walls 12A. 12B at spaced predetermined intervals.

A plurality of reinforcing ribs 72 (represented as a plurality of one-side reinforcing rib 72A) are disposed in an axial direction on crank case 12 and extend outward at positions relative to respective first boss portions 70. Reinforcing ribs 72 serve to reinforce respective first boss portions 70, crank case 12, and resist horizontal distortion during engine operation.

A plurality of second boss portions 74 are disposed on V-shaped cylinder block 4 at positions above selected first boss portions 70.

An engine mount bracket 80 includes an upper and a lower bracket portion 80B, 80A. Engine mount bracket 80 spans the joint between the lower surface of V-shaped cylinder block 4 and the upper surface of crank case 12 and aids in securing V-type engine 2 to a fixed point (not shown).

A set of first tightening bolts 76 fixes lower bracket portions 80A to selected first boss portions 70. A set of second tightening bolts 78 fixes upper bracket portions 80B to second boss portions 74.

First boss portions 70 are formed on respective one-side and opposite-side case side walls 12A, 12B at relatively lower positions on bearing construction member 10. In contrast, second boss portions 74 are formed on block side wall 4A of V-shaped cylinder block 4 at relatively higher positions.

During operation of eight-cylinder V-type engine 2, multiple loads are applied to crank shaft 16 and received by bearing caps 14. These loads include loads from one-side pistons 52A and one-side connecting rods 46A. The loads also include loads from opposite-side pistons 52B and opposite-side connecting rods 46B.

During one-side cylinder ignition, the loads from respective one-side cylinders 20A pass along a vector on one-side cylinder center line CA. During opposite-side cylinder ignition, the loads from respective opposite-side cylinders 20B pass a long a vector on opposite-side cylinder center line CB.

Eight cylinder V-type 2 engine is effected by both the ignition sequence and the inertial forces of first through fourth crank weights 30-1 to -4 in a manner different from four and six cylinder engines. For example, during ignition of V-type 2 engine, when the fourth cylinder is ignited, loads having horizontal components are applied to bearing caps 14. As a second example, when the third cylinder is ignited, a similar horizontal load component is also applied to bearing caps 14.

Figure 5:
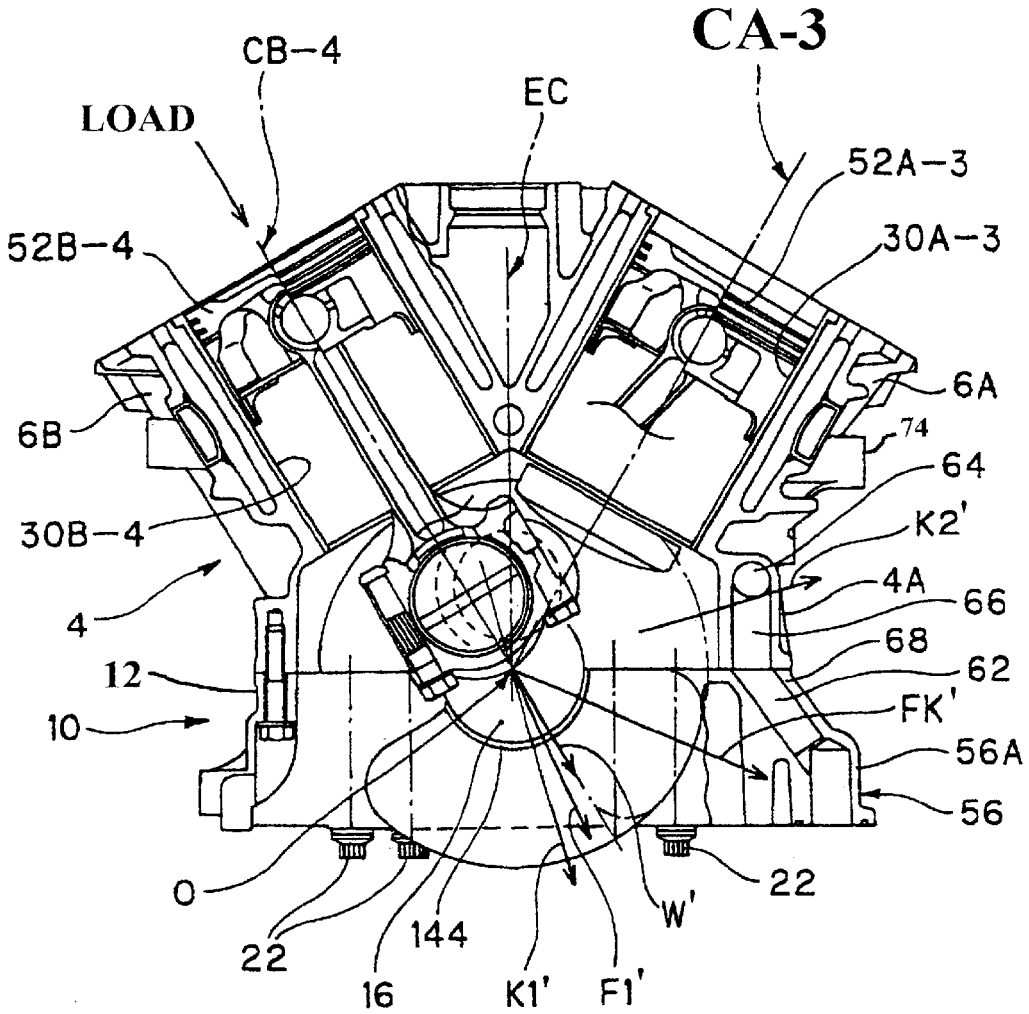
FIG. 5 is a view explaining the directions of loads applied from the crank shaft.

Referring now to FIG. 5, fourth opposite-opposite side piston 52B-4 receives an explosion load along the direction of fourth opposite-side cylinder center line CB-4. At the same time, this load is applied to a respective bearing cap 14. Simultaneously, an inertial force of third counter weight 30-3 (on crank shaft 16) is at least twice as large as an inertial force of second counter weight 30-2.

Upon the ignition of fourth opposite-side piston 52B-4, a resultant force FK' is applied horizontally along bearing caps 14. Resultant force FK' is obtained by adding a resultant force F1' (of a load W' and an inertial force K1') to an inertial force K2'. A similar phenomenon arises when ignition occurs in sixth opposite-side cylinder (20B-6, not shown). Upon ignition of the sixth cylinder, a resultant force of an explosion load and the inertial force of fourth counter weight 30-4 (A and B combined) is applied horizontally through the affect of the above inertial force. The remaining loads are not substantially applied horizontally. A reader should note that bulge portion 56, while serving multiple purposes, serves to brace bearing construction member 10 against resultant force FK'.

As a benefit if the present design, to reduce the total length of V-type engine 2, oil pump 58 is mounted to the lower end of bulge portion 56 projecting away from the side of crank case 12. As a further design benefit to minimize interference with crank shaft 16, oil pump 58 extends outward from crank case.

To increase horizontal rigidity of bearing caps 14, oil path boss portion extends outward from V-shaped cylinder block 4 and allows first oil path 62 to communicates with second oil path 66.

To further increase horizontal rigidity and minimize horizontal deformation in bearing construction member 10, first boss portions 70 (with respective reinforcing ribs 72 on case side wall 12A) are formed on crank case 12.

As a result of the present design, even where loads are applied in a horizontal manner relative to crank shaft 16, engine vibration and noise can be reduced by reducing the clearances of case side shaft holes 40-1 to 40-5. The clearances of case side shaft holes 40-1 to 40-5 is achievable by improving the rigidity of one-side case side wall 12A and preventing deformation of lower mounting bolts 22. The rigidity of one-side case side wall 12A is enhanced through the interactive support of the elements noted above and from respective first and second boss portions 70, 74 and engine mount bracket 80.

As a further benefit of the present invention, it is not necessary to increase the wall thickness of case side wall 12A of crank case 12, to add additional supporting members to crank case 12, or to change the material of crank case 12 to iron. These benefits reduce both weight and manufacturing costs.

An additional benefit positions oil pump 58 at a location that minimizes the total length of V-type engine 2 and prevents interference with crank shaft 12.

Figure 6:
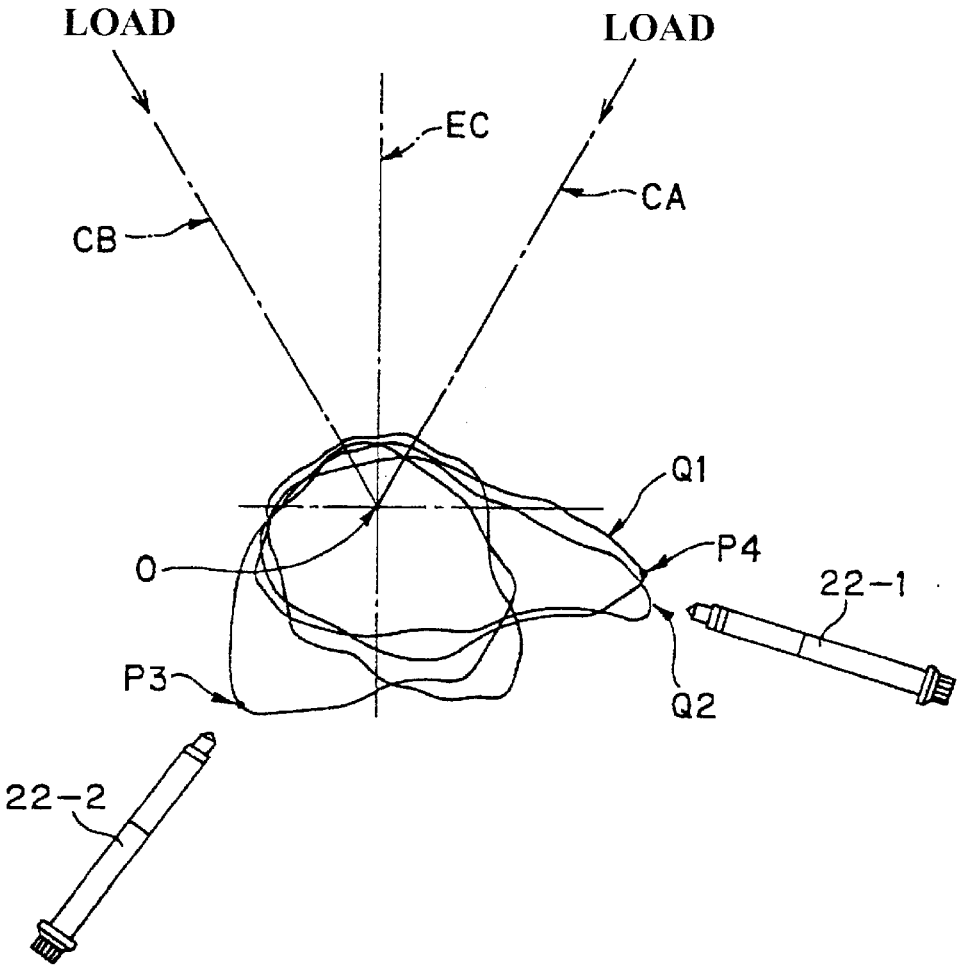
FIG. 6 is a view showing the directions in which lower mounting bolts are attached in a second embodiment of the present invention.

Referring now to FIG. 6, a second embodiment of the present invention positions lower mounting bolts 22-1 and 22-2 in oblique positions directly along the horizontal loads applied to crank case 12 from crank shaft 16. As in the previous embodiment, lower mounting bolts 22 mount crank case 12 on the lower surface of cylinder block 4. In this embodiment, since the horizontal loads from crank shaft 16 are applied in axial directions respective to lower mounting bolts 22, deformation is effectively prevented for both bearing caps 14 and respective case side shaft holes 42.

Figure 7:
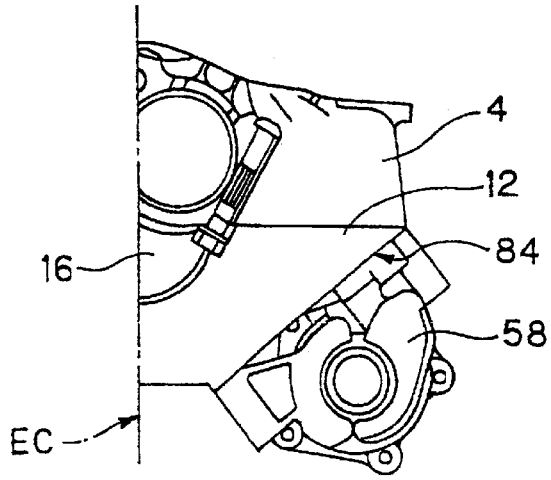
FIG. 7 is a front elevational view in part showing an oil pump mounted obliquely in a third embodiment.
Figure 8:
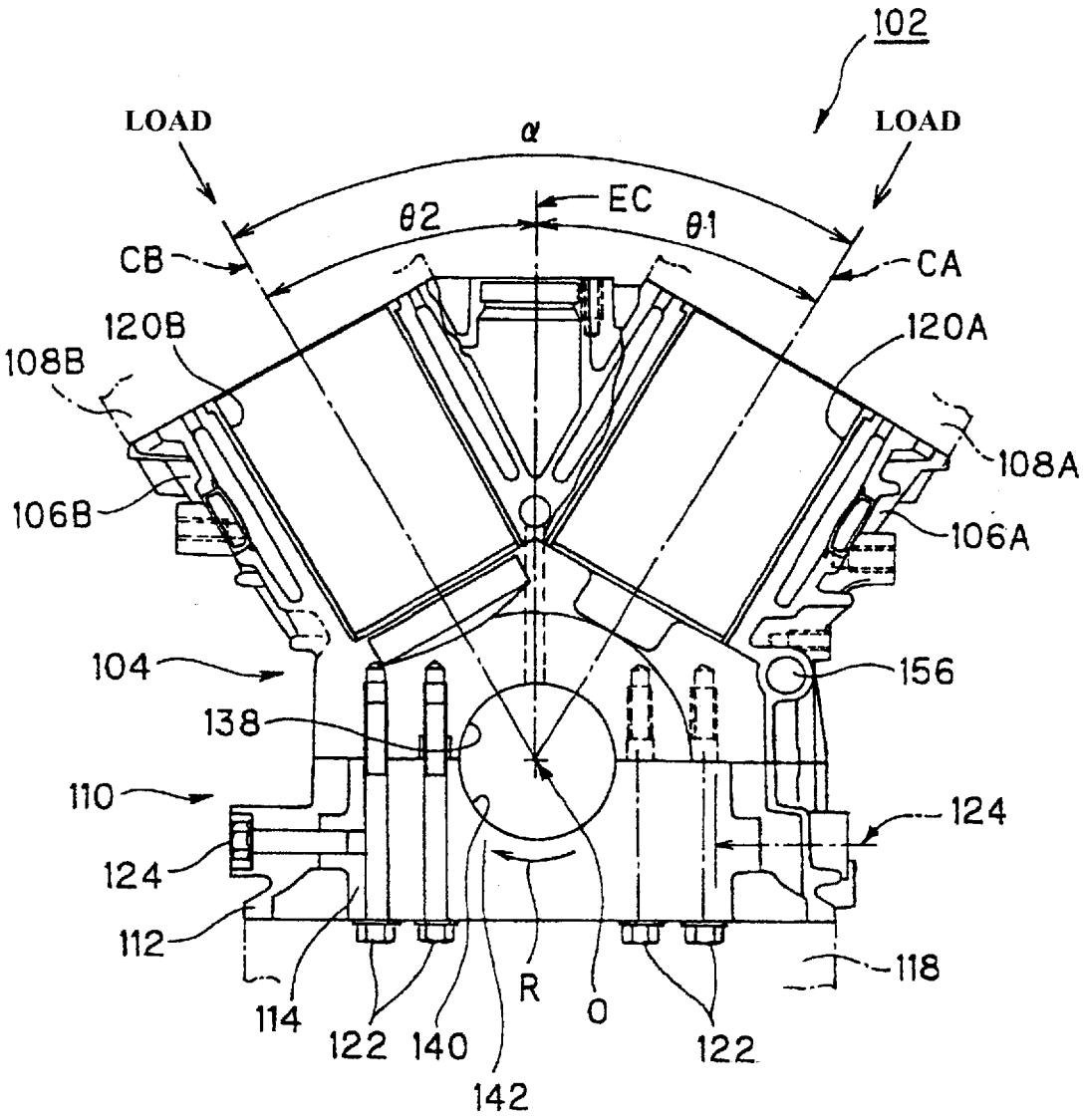
Fig. 8 PRIOR ART
FIG. 8 is a sectional view schematically showing a conventional V-type engine without connecting rods and pistons.
Figure 9:
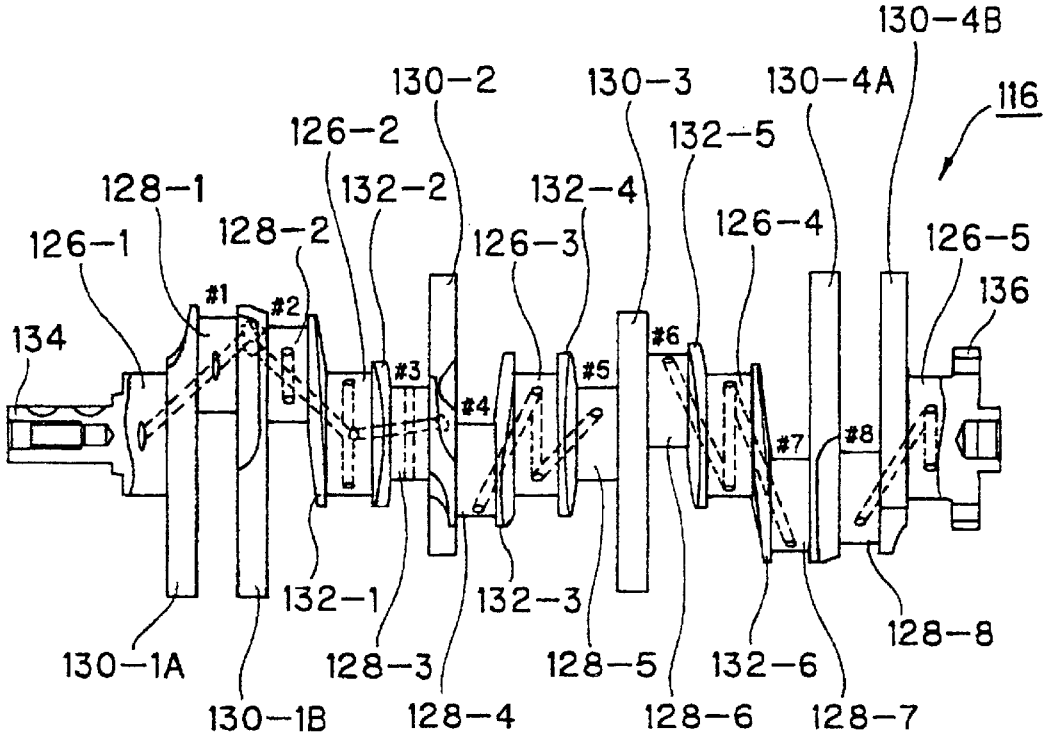
Fig. 9 PRIOR ART
FIG. 9 is a side elevational view of a conventional crank shaft.
Figure 10:
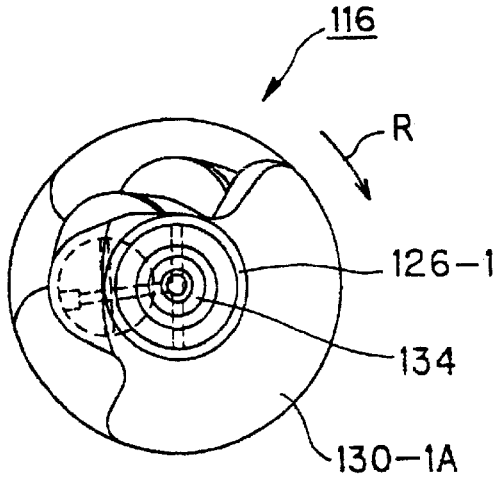
PRIOR ART Fig. 10
FIG. 10 is a front elevational view of the crank shaft shown in FIG. 9 when it is viewed from an end thereof.
Figure 11:
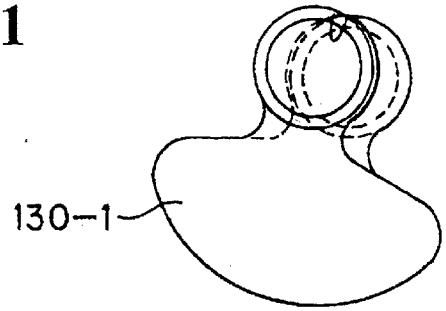
PRIOR ART Fig. 11
FIG. 11 is a side elevational view of the first crank weight of the crank shaft shown in FIG. 9.
Figure 12:
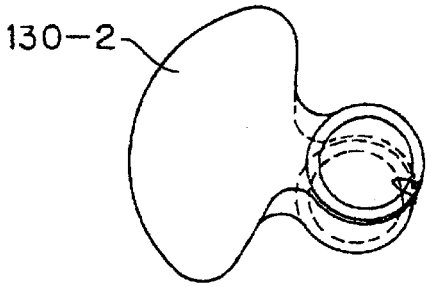
PRIOR ART Fig. 12
FIG. 12 is a side elevational view of the second crank weight of the crank shaft shown in FIG. 9.
Figure 13:
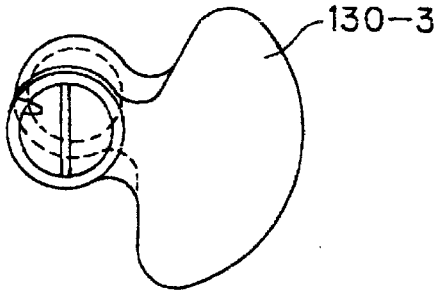
PRIOR ART Fig. 13
FIG. 13 is a side elevational view of the third crank weight of the crank shaft shown in FIG. 9.
Figure 14:
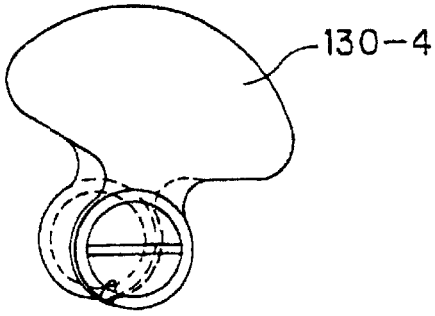
PRIOR ART Fig. 14
FIG. 14 is a side elevational view of the fourth crank weight of the crank shaft shown in FIG. 9.
Figure 15:
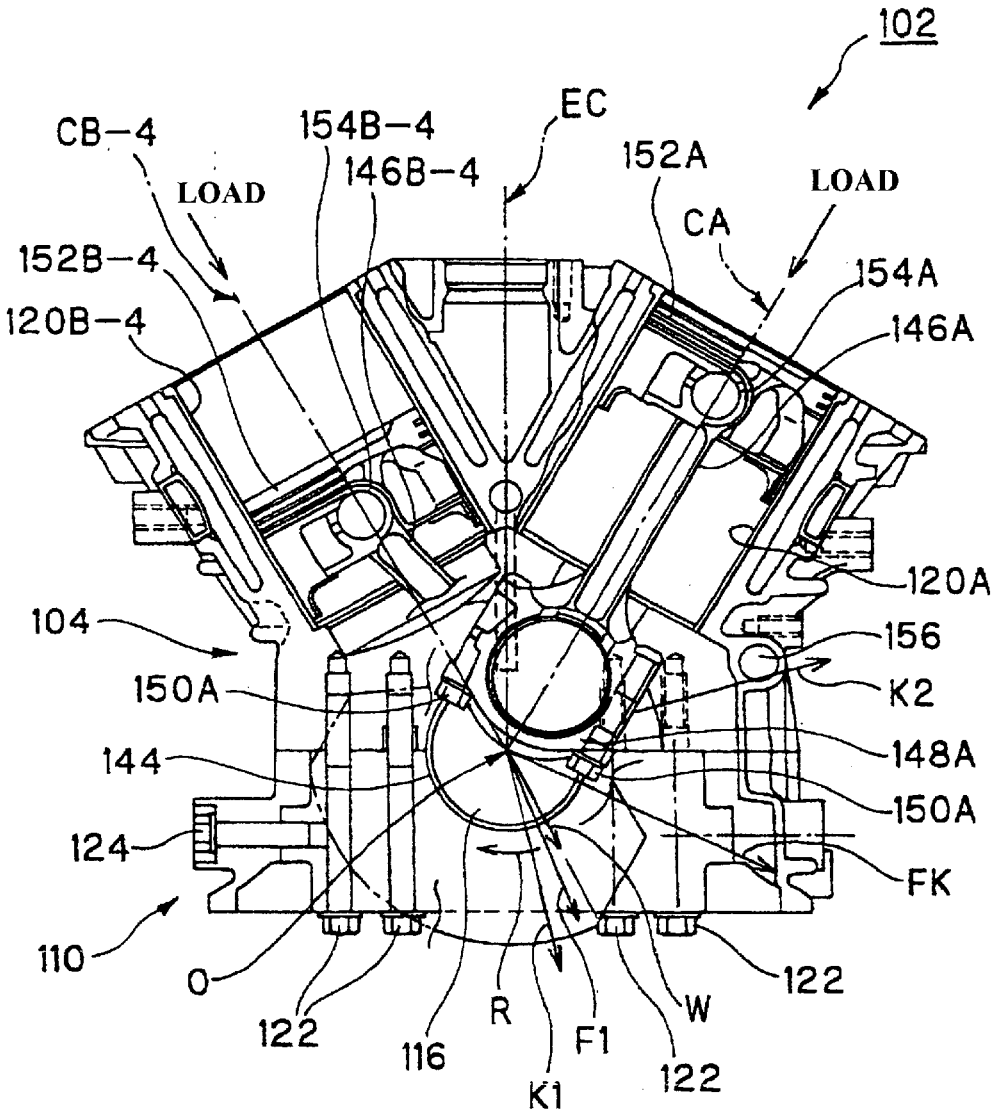
Fig. 15 PRIOR ART
FIG. 15 is a sectional view of the conventional V-type engine assembled with selected connecting rods and pistons.
Figure 16:
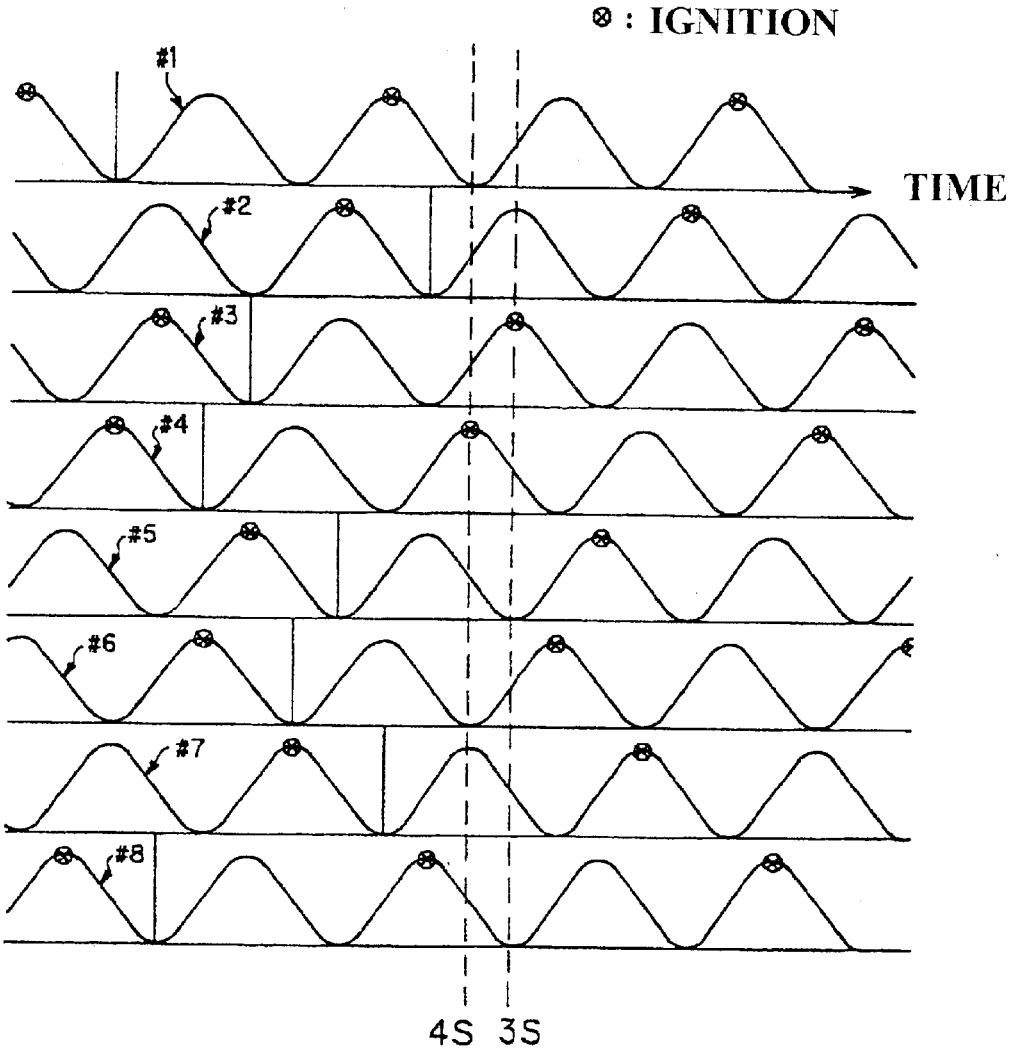
Fig. 16 PRIOR ART
FIG. 16 is a view explaining an ignition sequence of a V-type engine.
Figure 17:
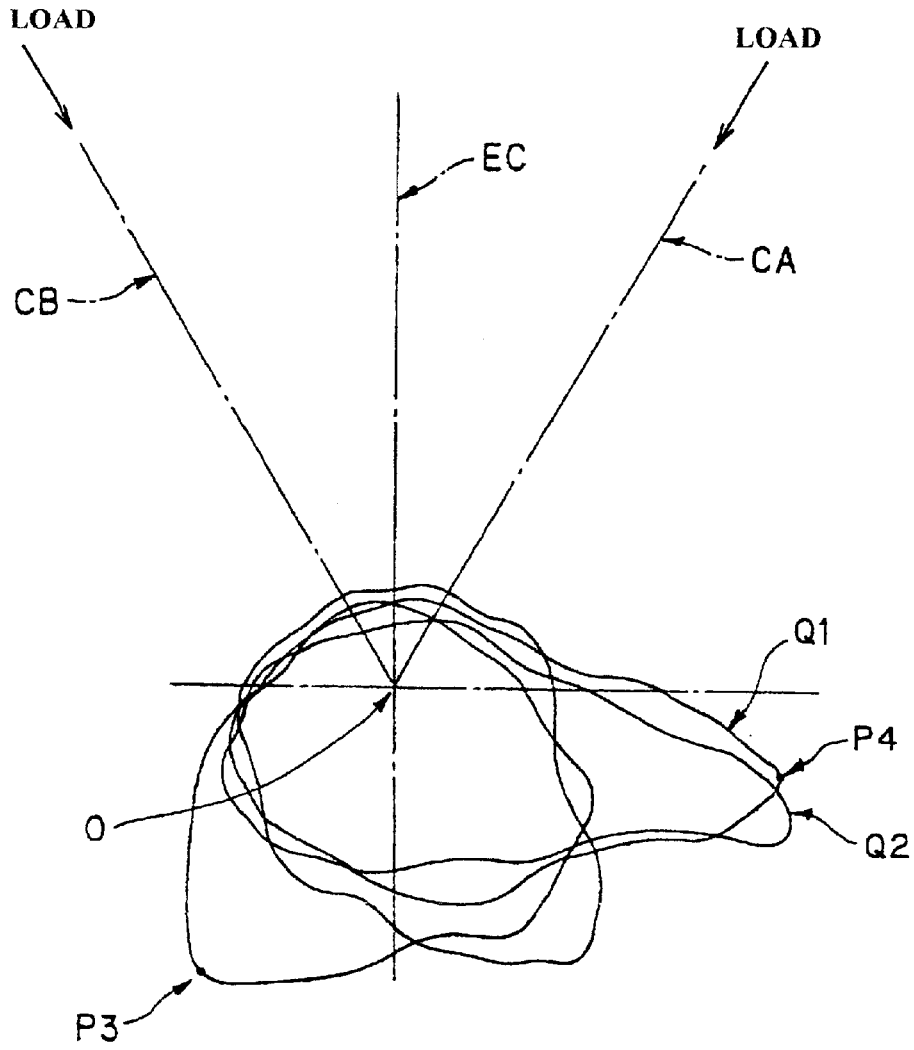
Fig. 17 PRIOR ART
FIG. 17 is a view explaining the directions and magnitudes of loads applied to respective bearing portions in a V-type engine.

Referring now to FIG. 7, a third embodiment of the present invention includes a pump-mounting inclined surface 84. Pump-mounting inclined surface 84 is substantially perpendicular to the horizontal loads applied from crank shaft 16 and is on the lower surface of crank case 12. In the third embodiment, oil pump 58 mounts to pump-mounting inclined surface 84. The position and thickness of pump-mounting inclined surface 84 increases the rigidity of crank case 12 and case side wall 12A (not shown) and simplifies construction through elimination of additional linking members.

Readers skilled in the art should note that, as is shown the referenced drawing, the 'horizontal forces' applied to deform respective V-type engines 2 are forces having a substantial horizontal vector or component and are so labeled for convenience only. Thus, the above invention is not limited to countering those forces applied in a solely horizontal manner but to those forces having an undesirable or damaging horizontal component.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cylinder block structure, comprising:

a crank case;

said crank case being disposed on a first lower surface of a V-type cylinder block;

a first set of bearing caps mounted on said crank case;

said cylinder block and said first set of bearing caps operably supporting a crank shaft along a center axis of said cylinder block structure;

said crank shaft transmitting a distorting horizontal force to at least said first set and a one-side wall of said crank case during an engine operation;

means for preventing a distortion of said at least first set and said one-side wall during said engine operation;

at least a bulge portion in said means for preventing; and said bulge portion extending away from at least said one-side wall and reinforcing said first set and said one-side wall, whereby said means for preventing resists said distorting horizontal force and prevents said distortion.

2. A cylinder block structure, according to claim 1, further comprising:

an oil pump in said means for preventing;

said oil pump being mounted on a second lower surface of said bulge portion opposite said crank shaft;

a first oil path in said means for preventing;

a first oil path being in a bulge side surface of said bulge portion opposite said crank shaft;

said first oil path in fluid communication with a discharge path of said oil pump;

a second oil path in said means for preventing; a second oil path on said a block side wall of said cylinder block opposite said crank shaft; and said second oil path providing fluid communication between said first oil path and a main oil path in said cylinder block, whereby said oil pump and said first and said second oil paths resists said distortion.

3. A cylinder block structure, according to claim 2, further comprising:

a plurality of first boss portions in said means for preventing;

said first boss portions on said one-side wall and an opposite-side wall of said crank case extending away from said crank case at spaced intervals perpendicular to said crank shaft;

a plurality of second boss portions in said means for preventing;

said second boss portions being disposed on at least a one-side cylinder block wall of said cylinder block extending away from said cylinder block at spaced intervals perpendicular to said crank shaft and relative to corresponding ones of said first boss portions;

an engine mounting bracket in said means for preventing; and said engine mounting bracket rigidly joining at least one of said second boss portions and at least one of said first boss portions on said one-side wall to an external support, whereby said engine mounting bracket prevents distortion of said crank case and said cylinder block relative to said external support.

4. A cylinder block structure, according to claim 3, further comprising:

a plurality of reinforcing ribs in said means for preventing; and said plurality of reinforcing ribs being disposed on said plurality of first boss portions on said one-side wall, whereby said reinforcing ribs stiffen said plurality of first boss portions to prevent distortion of said crank case.

5. A cylinder block structure, comprising:

a crank case;

an upper surface of said crank case on a lower surface of a V-shaped cylinder block;

a bearing construction member including said crank case and a plurality of bearing caps;

an oil pan on a lower surface of said crank case;

said plurality of bearing caps and said crank case rotatably supporting a crank shaft along a rotation axis in said bearing construction member;

a bulge portion on at least a first case side wall of said crank case extending away from said crank case;

said bulge portion having a shape and being at a position countering a distorting horizontal force from said crank shaft transmitted to said bearing caps and said crank case during an engine operation;

an oil pump on a lower surface of said bulge portion;

a first oil path on a bulge side surface of said bulge portion in fluid communication with a discharge path of said oil pump; and a second oil path on a block side wall of said cylinder block in fluid communication between said first oil path and a main oil path of said cylinder block, whereby said oil pump, said first oil path, and said second oil path support said bulge portion and resist said distorting horizontal load.

6. A cylinder block structure, according to claim 5, further comprising:

a plurality of first boss portions on said first and a second case side wall of said crank case;

said plurality of first boss portions extending away from crank case at spaced intervals perpendicular to said crank shaft;

a plurality of second boss portions on at least a first cylinder side wall of said cylinder block;

said plurality of second boss portions extending away from said cylinder block at spaced intervals perpendicular to said crank shaft and relative to respective said first boss portions;

at least one engine mounting bracket fixed to an external support;

said engine mounting bracket having at least an upper and a lower portion;

said upper portion fixed to at least one of said second boss portions on said cylinder block on said first cylinder side wall;

said lower portion fixed to at least one of said first boss portions on said crank case on said first case side wall; and said engine mounting bracket extending away from said cylinder block and said crank case to said external support, thereby preventing said distorting horizontal load from shifting said crank case, said cylinder block, and said set of bearing caps relative to said external support during said engine operation.

7. A cylinder block structure, according to claim 6, further comprising:

a plurality of reinforcing ribs on said plurality of first boss portions along said first case side wall; and said reinforcing ribs stiffening said plurality of first boss portions along said first case side.

8. A cylinder block structure, comprising:

a crank case;

an upper surface of said crank case located on a first lower surface of a V-shaped cylinder block;

a bearing construction member;

said bearing construction member including said crank case and a plurality of bearing caps;

said plurality of bearing caps and said crank case rotatably supporting a crank shaft along a rotation axis of said crank case;

at least a pump-mounting inclined surface on a second lower surface of said crank case;

an oil pump mounted on said pump-mounting inclined surface;

said pump-mounting inclined surface having a shape and a thickness countering a distorting horizontal force from said crank shaft transmitted to said bearing caps and said crank case during an engine operation; and said thickness of said pump-mounting inclined surface also increasing a rigidity of at least one case side wall of said crank case.

9. A cylinder block structure, comprising:

a crank case;

at least a first set of bearing caps mounted on said crank case;

means for preventing distortion of bearing caps and said crank case during an engine operation transmitting a distorting horizontal force to said bearing caps and said crank case;

a bulge portion in said means for preventing; and said bulge portion extending away from a first side wall of said crank case to reinforce at least one of said crank case and said bearing caps and resist said distorting horizontal force, whereby distortion of said cylinder block structure is prevented.

* * * * *